US010843894B2

(12) United States Patent
Bender

(10) Patent No.: US 10,843,894 B2
(45) Date of Patent: Nov. 24, 2020

(54) GROUND THAWING HOSE CLEANING REEL GUIDE ASSEMBLY

(71) Applicant: Eric Bender, Sioux Falls, SD (US)

(72) Inventor: Eric Bender, Sioux Falls, SD (US)

( * ) Notice: Subject to any disclaimer, the term of this patent is extended or adjusted under 35 U.S.C. 154(b) by 239 days.

(21) Appl. No.: 15/988,022

(22) Filed: May 24, 2018

(65) Prior Publication Data

US 2019/0359446 A1 Nov. 28, 2019

(51) Int. Cl.

| | |
|---|---|
| ***B65H 75/44*** | (2006.01) |
| ***B65H 75/42*** | (2006.01) |
| ***B65H 57/14*** | (2006.01) |
| ***B65H 57/10*** | (2006.01) |
| ***B08B 9/023*** | (2006.01) |

(52) U.S. Cl.

CPC ..... *B65H 75/441* (2013.01); *B08B 9/023* (2013.01); *B65H 57/10* (2013.01); *B65H 57/14* (2013.01); *B65H 75/425* (2013.01); *B65H 2404/10* (2013.01); *B65H 2404/512* (2013.01); *B65H 2601/20* (2013.01); *B65H 2701/33* (2013.01); *Y10T 137/6899* (2015.04); *Y10T 137/6954* (2015.04)

(58) Field of Classification Search

CPC .... B65H 57/10; B65H 57/14; B65H 75/4402; B65H 75/4405; B65H 75/441; B65H 2404/10; B65H 2404/512; B65H 2601/20; B65H 2601/255; B65H 2601/261; B65H 2601/271; B65H 2601/272; B65H 2601/325; B65H 2601/326; B65H 2601/425; B65H 2601/523; B65H 2701/33; B08B 9/023; Y10T 137/6899; Y10T 137/6954

USPC ..... 137/355.12, 355.21, 355.2, 355.26

See application file for complete search history.

(56) References Cited

U.S. PATENT DOCUMENTS

| | | | | | |
|---|---|---|---|---|---|
| 513,083 | A * | 1/1894 | Carsten | B65H 75/425 | 242/391.3 |
| 573,853 | A * | 12/1896 | Bird | B08B 9/023 | 15/104.04 |
| 2,090,445 | A * | 8/1937 | Hale | B65H 75/42 | 242/397.4 |
| 2,738,143 | A * | 3/1956 | Hannay | B65H 75/4486 | 242/157.1 |
| 2,933,264 | A * | 4/1960 | Bullen et al. | B65H 57/14 | 242/157.1 |
| 4,076,272 | A * | 2/1978 | Penton | B60D 1/62 | 137/355.12 |
| 4,148,445 | A * | 4/1979 | Reynolds | B65H 75/425 | 242/388.7 |
| 4,213,596 | A * | 7/1980 | Inoue | B60M 1/28 | 254/134.3 R |

(Continued)

*Primary Examiner* — Kenneth Rinehart
*Assistant Examiner* — Jonathan J Waddy

(57) ABSTRACT

A ground thawing hose cleaning reel guide assembly cleans a ground thawing hose as the hose is reeled back onto a reel within a vehicle. The assembly includes a hose guide coupled to a frame such that the hose guide is movable between opposite ends of the frame. The hose guide has an interior edge defining an aperture extending through the hose guide. A sheet is coupled to the hose guide extending over the aperture. A channel extends into the sheet. The channel is configured to receive a hose within the channel whereby the sheet is configured to scrape debris from the hose as the hose is moved through the hose guide.

10 Claims, 6 Drawing Sheets

(56) References Cited

U.S. PATENT DOCUMENTS

| | | | | | |
|---|---|---|---|---|---|
| 4,540,017 | A * | 9/1985 | Prange | B65H 75/441 | 137/355.12 |
| 4,603,516 | A * | 8/1986 | Hoffman | B24C 3/06 | 451/76 |
| 4,895,205 | A * | 1/1990 | Thompson | E21B 17/006 | 166/311 |
| 5,070,569 | A * | 12/1991 | Wilkins | A46B 7/02 | 15/160 |
| 5,881,419 | A * | 3/1999 | Millard | A62C 33/02 | 15/104.04 |
| 6,153,016 | A * | 11/2000 | Rauch | B08B 9/021 | 134/6 |
| 9,499,373 | B1 * | 11/2016 | Kim | A47F 7/024 | |
| 2003/0006034 | A1 * | 1/2003 | Neal | B65H 75/4402 | 166/77.2 |
| 2017/0235017 | A1 * | 8/2017 | Vasbo | G01V 13/00 | 134/9 |

* cited by examiner

GROUND THAWING HOSE CLEANING REEL GUIDE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to reel guide devices and more particularly pertains to a new reel guide device for cleaning a ground thawing hose as the hose is reeled back onto a reel within a vehicle.

BRIEF SUMMARY OF THE INVENTION

An embodiment of the disclosure meets the needs presented above by generally comprising a hose guide coupled to a frame such that the hose guide is movable between opposite ends of the frame. The hose guide has an interior edge defining an aperture extending through the hose guide. A sheet is coupled to the hose guide extending over the aperture. A channel extends into the sheet. The channel is configured to receive a hose within the channel whereby the sheet is configured to scrape debris from the hose as the hose is moved through the hose guide.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
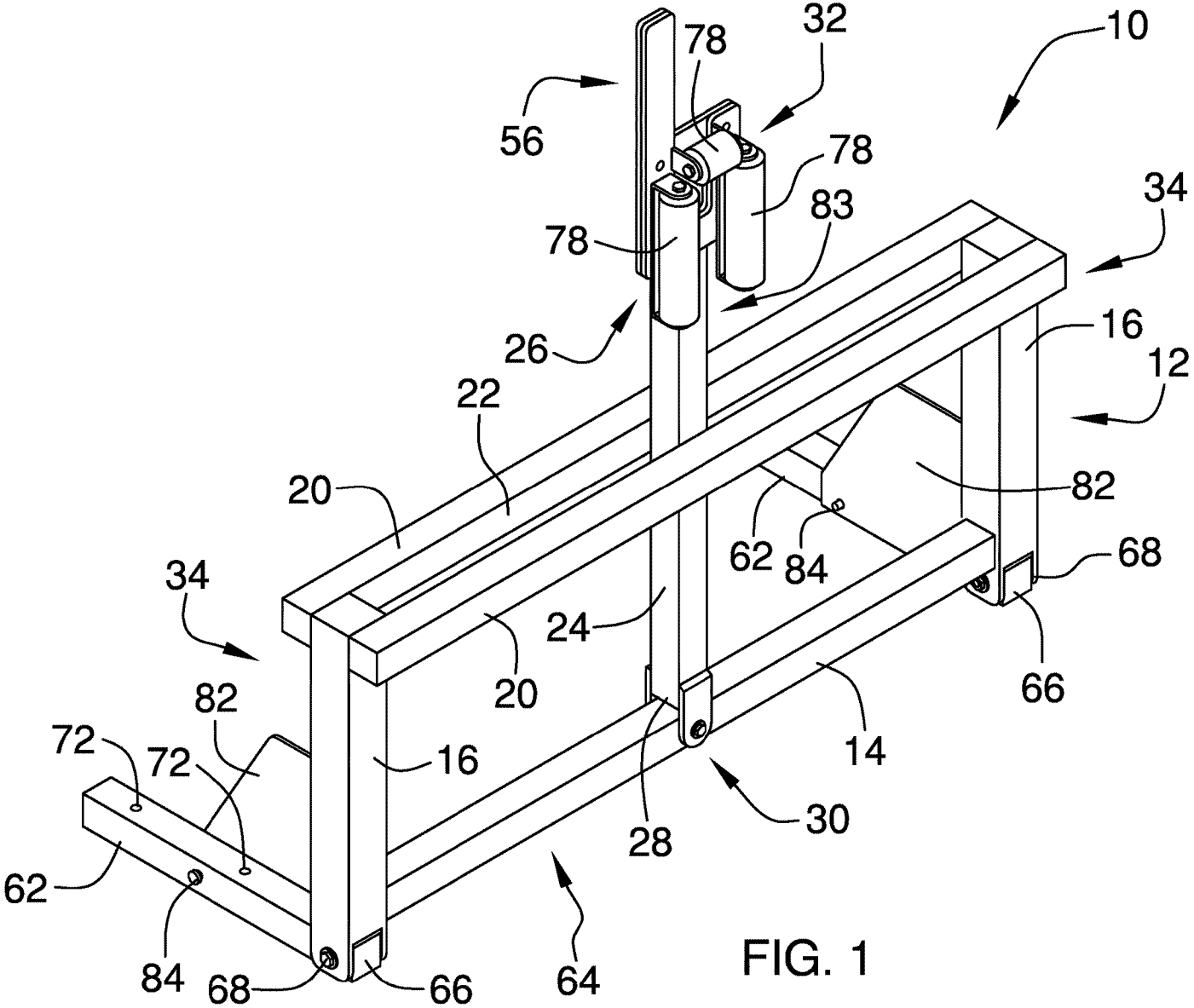
FIG. 1 is a top front perspective view of a ground thawing hose cleaning reel guide assembly according to an embodiment of the disclosure.
Figure 2:
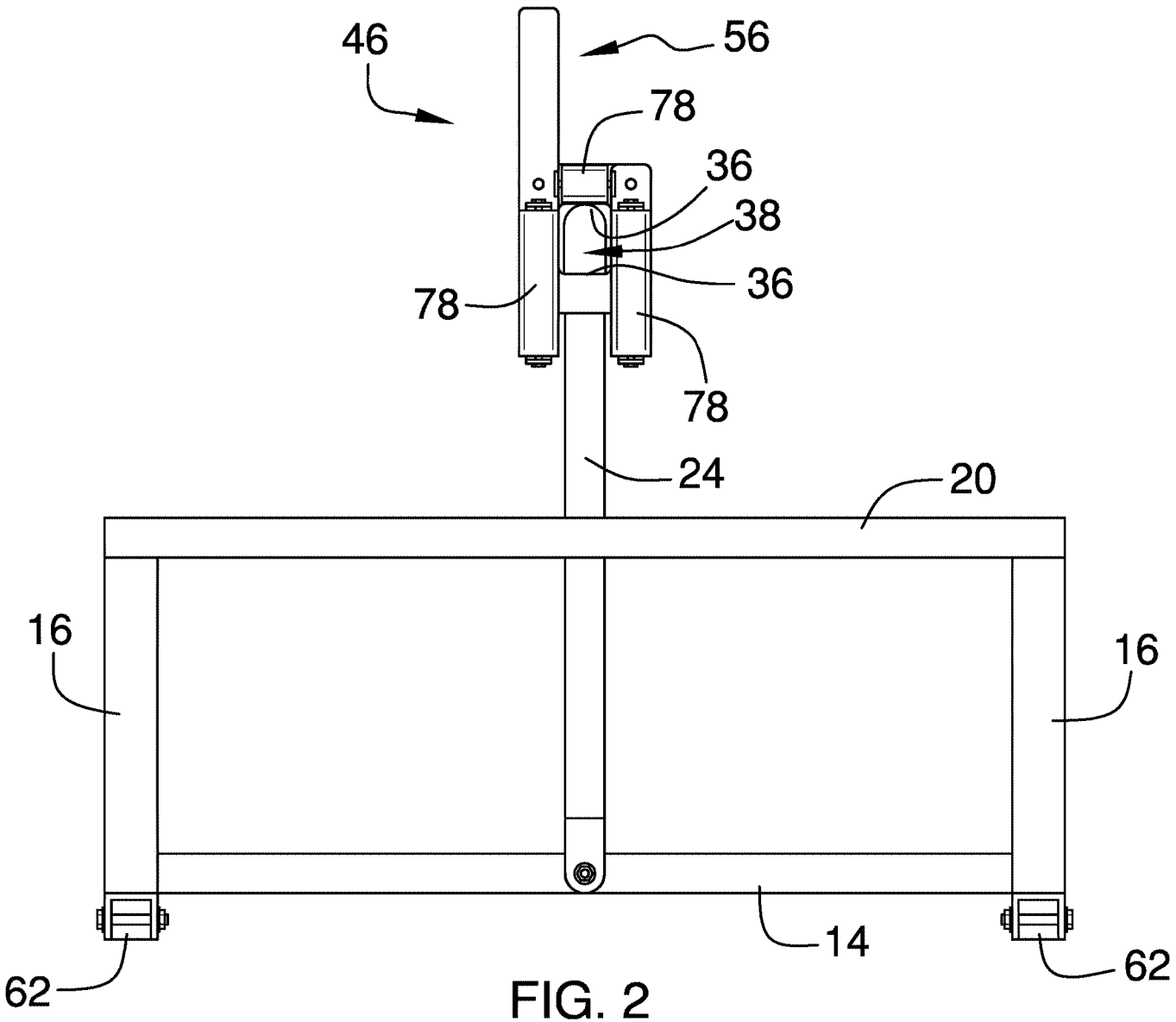
FIG. 2 is a front view of an embodiment of the disclosure.
Figure 3:
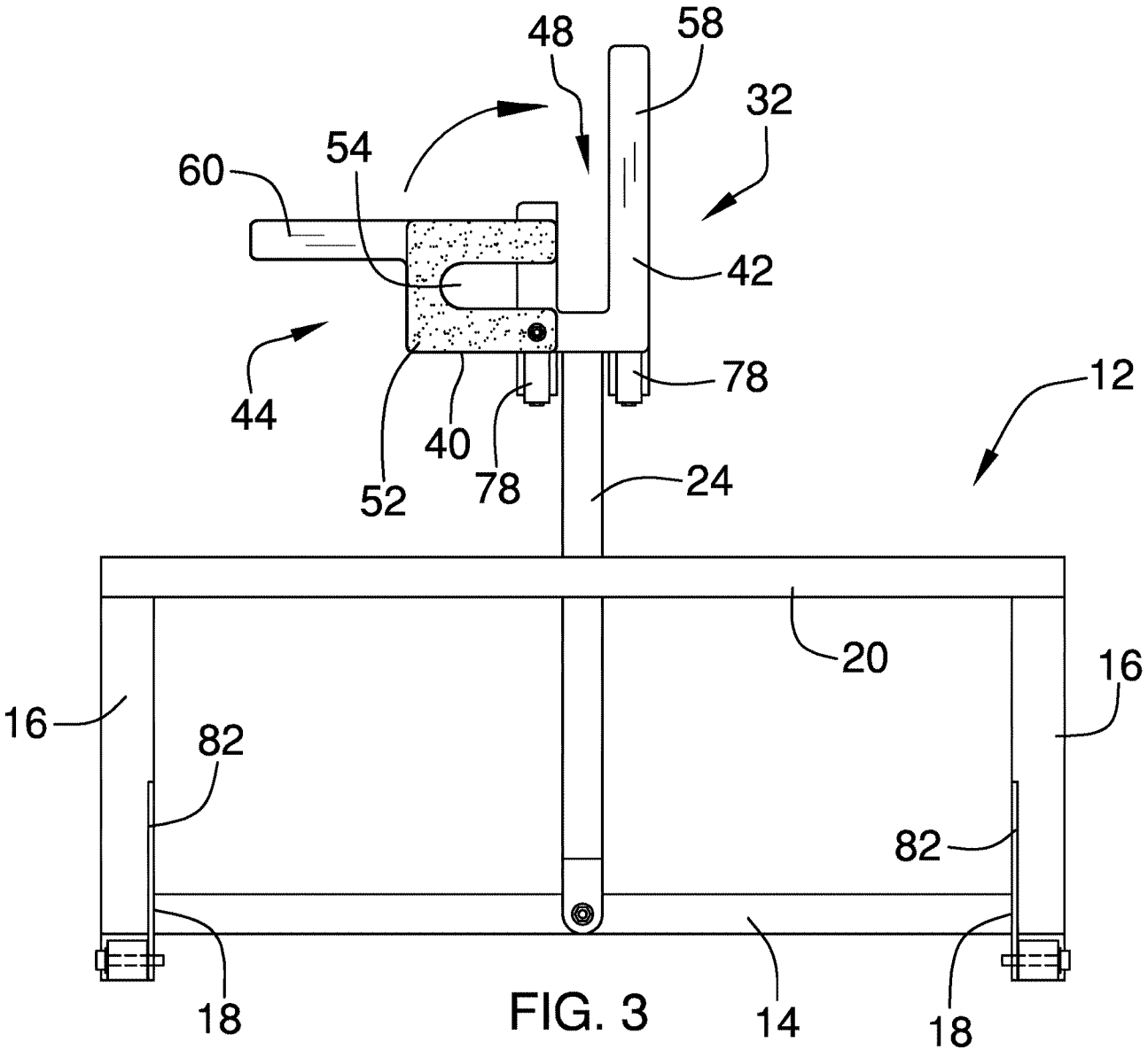
FIG. 3 is a rear view of an embodiment of the disclosure.
Figure 4:
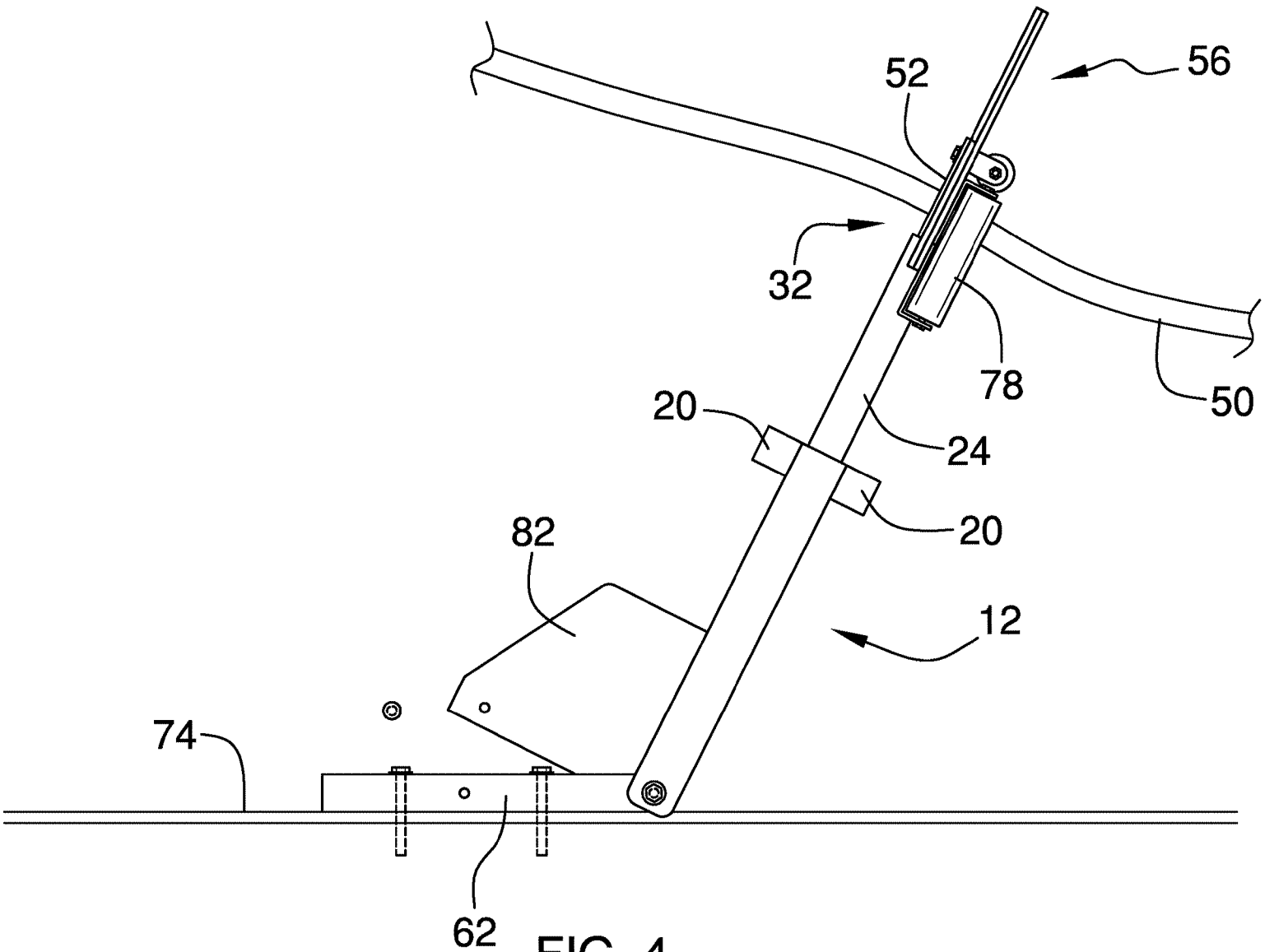
FIG. 4 is a side view of an embodiment of the disclosure.
Figure 5:
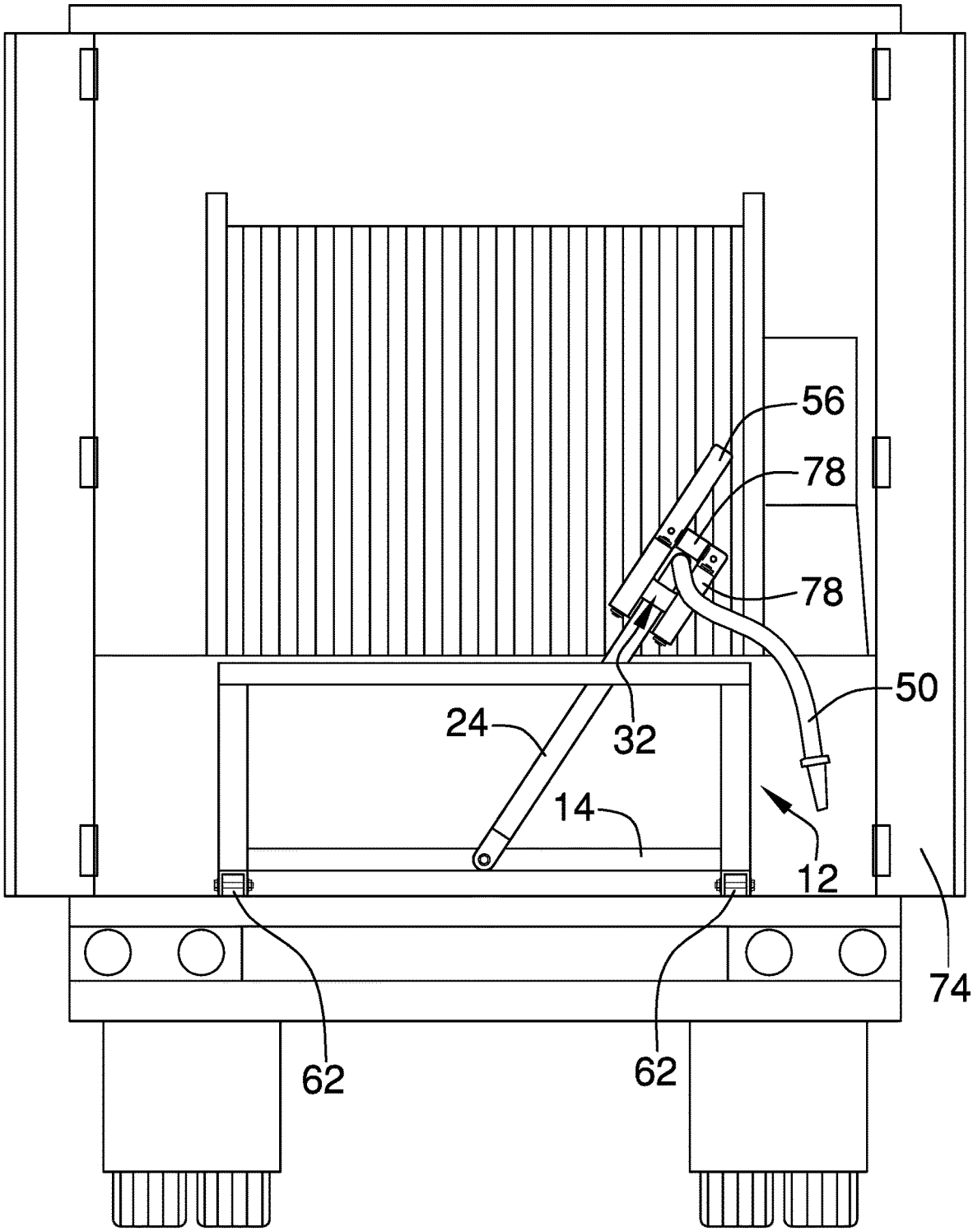
FIG. 5 is a front view of an embodiment of the disclosure in use.

With reference now to the drawings, and in particular to FIGS. 1 through 6 thereof, a new reel guide device embodying the principles and concepts of an embodiment of the disclosure and generally designated by the reference numeral 10 will be described.

As best illustrated in FIGS. 1 through 6, the ground thawing hose cleaning reel guide assembly 10 generally comprises a frame 12 having a base bar 14 and a pair of lateral sides 16. Each of the lateral sides 16 is coupled to and extends from a respective end 18 of the base bar 14. The frame 12 has a pair of top bars 20 coupled to and extending between the lateral sides 16. The top bars 20 are parallel and spaced to define a slot 22 between the top bars 20. The slot 22 is vertically aligned with the base bar 14. A pivot arm 24 has a first end 26 and a second end 28. The first end 26 is pivotally coupled to the frame 12. The second end 28 of the pivot arm 24 is coupled to a middle 30 of the frame 12 on the base bar 14. The pivot arm 24 extends through the slot 22.

A hose guide 32 is coupled to the frame 12 such that the hose guide 32 is movable between opposite ends 34 of the frame 12. The hose guide 32 is coupled to the second end 28 of the pivot arm 24. The hose guide 32 has an interior edge 36 defining an aperture 38 extending through the hose guide 32. The hose guide 32 has a pivot section 40 pivotally coupled to a fixed section 42. The fixed section 42 is fixedly coupled to the second end 28 of the pivot arm 24. The pivot section 40 is pivotable between an open position 44 and a closed position 46. The pivot section 40 and the fixed section 42 overlap in the closed position 46 to define the interior edge 36 and the aperture 38. The pivot section 40 and the fixed section 42 define an opening 48 into the aperture 38 when in the open position 44. Thus, the pivot section 40 is configured for being pivoted into the open position 44 to permit insertion of a hose 50 into the aperture 38. A sheet 52 is coupled to the hose guide 32. The sheet 52 extends over the aperture 38. A channel 54 extends into the sheet 52. The channel 54 is configured to receive the hose 50 within the channel 54 whereby the sheet 52 is configured to scrape debris from the hose 50 as the hose 50 is moved through the hose guide 32.

Figure 6:
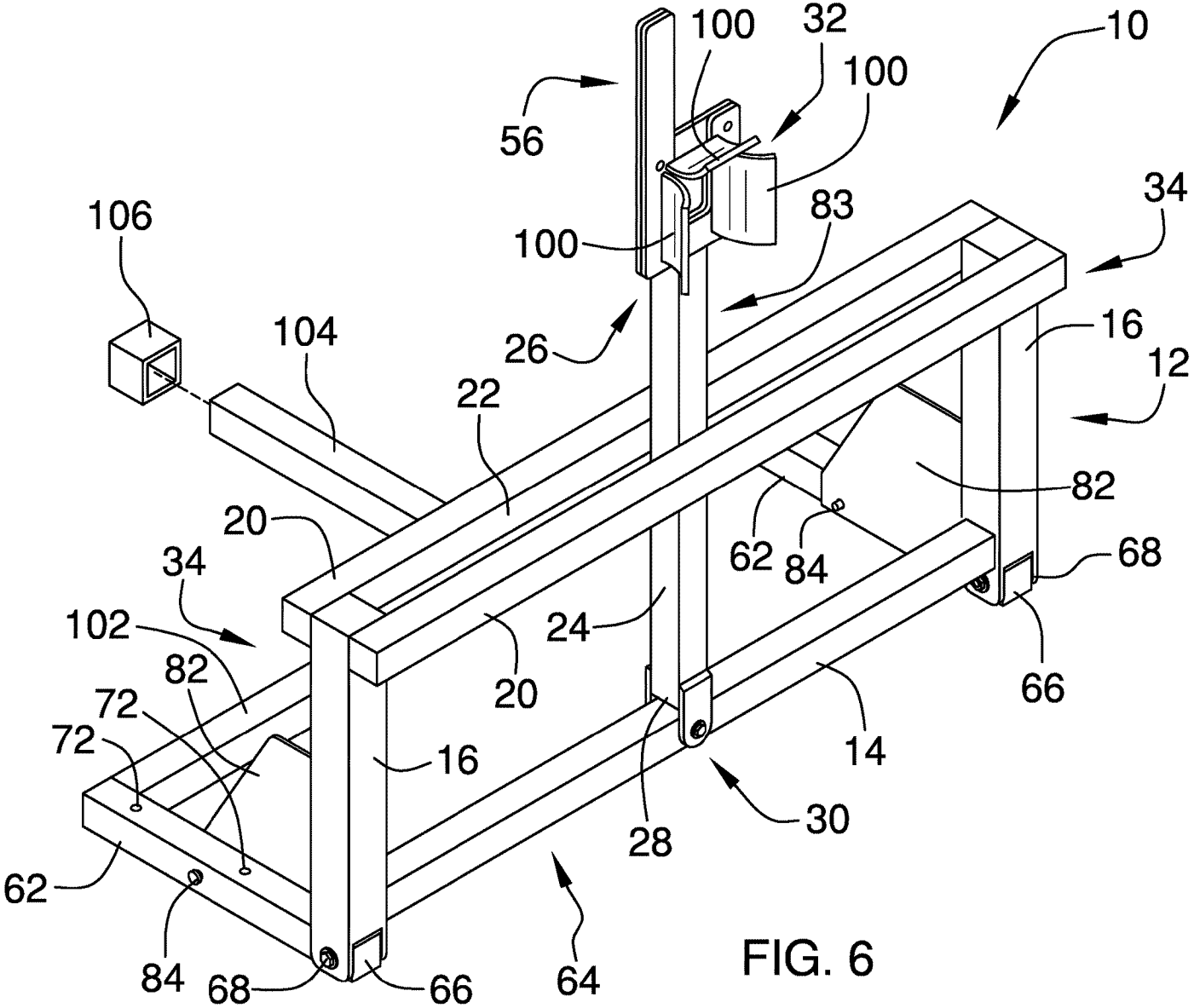
FIG. 6 is a top front perspective view of an embodiment of the disclosure.

Each of a plurality of rollers 78 is coupled to the hose guide 32 proximate to the aperture 38 wherein each of the rollers 78 is configured to facilitate passing the hose 50 through the aperture 38. The plurality of rollers 78 is arranged into a U shape extending around the aperture 38. An open end 80 of the U shape is directed towards the pivot arm 24. Alternatively, as shown in FIG. 6, flat arcuate surfaces 100 curving as they extend from the hose guide 32 may be provided in place of the rollers 78 to similarly aid in passing the hose 50 through the aperture 38. Additionally shown in FIG. 6, a connection bar 102 may be coupled to the feet 62. The connection bar 102 may be T-shaped to provide a rearwardly extending connection beam 104 configured to connect with a collar 106 or the like coupled to the reel 70 mounted within a vehicle 74 or directly to the vehicle 74.

A handle 56 is coupled to and extends from the hose guide 32. The handle 56 has a first section 58 coupled to and extending from the fixed section 42 of the hose guide 32. The handle 56 has a second section 60 coupled to and extending from the pivot section 40. The first section 58 of the handle 56 is aligned with the second section 60 of the handle 56 when the pivot section 40 is in the closed position 46.

Each of a pair of feet 62 is coupled to and extends from the frame 12 wherein the feet 62 support the frame 12 in an upright position 64. Each of the feet 62 has a respective proximal end 66 coupled to the frame 12 and extends perpendicularly from a respective base 68 of an associated one of the lateral sides 16 of the frame 12 wherein the feet 62 are configured for extending towards the reel 70 mounted within the vehicle 74 such that the frame 12 is positionable between the reel 70 and an opening into the vehicle 74. Each of the feet 62 has a hole 72 extending therethrough wherein each of the feet 62 is configured to be fastened into a fixed position in the vehicle 74. The frame 12 is pivotable relative to the feet 62 wherein the frame 12 is configured for being pivoted outwardly from the vehicle 74 positioning the hose guide 32 laterally spaced outside of the vehicle 74 whereby debris contacting the sheet 52 and the hose guide 32 is urged to fall away from the hose 50 outside of the vehicle 74. Gussets 82 are fixed to the frame 12. A respective locking pin 84 is provided for selectively securing each gusset 82 to a respective one of the feet 62 to lock the frame 12 in the upright position.

In use, the assembly 10 cleans the hose 50 after the hose 50 has been used to thaw ground in a construction area or the like. During cold months, frozen ground is thawed by passing heated fluid through the hose 50 as described above while the hose 50 is positioned on the ground. Inherently, mud and other debris clings to the hose 50. Due to melting and condensation, the hose 50 will typically be wet and muddy when removed from the ground. The hose 50 is typically held in and moved from site to site within the vehicle 74. The assembly 10 allows for positioning of the hose 50 within the hose guide 32. As the reel 70 retracts the hose back into the vehicle 74, an operator can grasp the handle 56 and move the pivot arm 24 back and forth to neatly position the hose 50 on the reel 70. The frame 12 is pivoted to be horizontal to the ground allowing the rollers 78 to facilitate passing the hose 58 through the aperture 38 where contact with the sheet 52 removes debris from the hose 50 before the debris can enter the vehicle 74.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hose cleaning reel attachment assembly comprising:

a frame;

a hose guide coupled to said frame such that said hose guide is movable between opposite ends of said frame, said hose guide having an interior edge defining an aperture extending through said hose guide;

a sheet coupled to said hose guide, said sheet extending over said aperture; and a channel extending into said sheet, said channel being configured to receive a hose within said channel whereby said sheet is configured to scrape debris from the hose as the hose is moved through the hose guide;

a pivot arm having a first end and a second end, said second end being pivotally coupled to said frame, said hose guide being coupled to said first end wherein said hose guide is movable back and forth between said opposite ends of said frame to facilitate rolling the hose evenly onto a reel as the hose passes through said hose guide; and a plurality of smoothly arcuate surfaces extending from said hose guide proximate to said aperture wherein each of said smoothly arcuate surfaces is configured to facilitate passing the hose through said aperture, said plurality of smoothly arcuate surfaces being arranged into a U shape extending around said aperture, an open end of said U shape being directed towards said pivot arm.

2. The assembly of claim 1, further comprising said second end of said pivot arm being coupled to a middle of said frame.

3. The assembly of claim 1, further comprising said frame having a base bar, a pair of lateral sides, each of said lateral sides being coupled to and extending from a respective end of said base bar, said frame having a pair of top bars coupled to and extending between said lateral sides, said top bars being parallel and spaced to define a slot between said top bars, said slot being vertically aligned with said base bar, said pivot arm extending through said slot.

4. The assembly of claim 1, further comprising said hose guide having a pivot section pivotally coupled to a fixed section, said fixed section being fixedly coupled to said first end of said pivot arm, said pivot section being pivotable between an open position and a closed position, said pivot section and said fixed section overlapping in said closed position to define said interior edge and said aperture, said pivot section and said fixed section defining an opening into said aperture when in said open position wherein said pivot section is configured for being pivoted into said open position to permit insertion of the hose into said aperture.

5. The assembly of claim 4, further comprising a handle coupled to and extending from said hose guide, said handle having a first section coupled to and extending from said fixed section of said hose guide, said handle having a second section coupled to and extending from said pivot section, said first section of said handle being aligned with said second section of said handle when said pivot section is in said closed position.

6. The assembly of claim 1, further comprising a handle coupled to and extending from said hose guide.

7. The assembly of claim 1, further comprising a pair of feet, each of said feet being coupled to and extending from said frame wherein said feet support said frame in an upright position.

8. The assembly of claim 7, further comprising each of said feet having a respective proximal end coupled to said frame and extending perpendicularly from a respective base of an associated one of a pair of lateral sides of said frame wherein said feet are configured for extending towards a reel mounted within a vehicle such that said frame is positionable between the reel and an opening into the vehicle.

9. A hose cleaning reel attachment assembly comprising:

a frame;

a hose guide coupled to said frame such that said hose guide is movable between opposite ends of said frame, said hose guide having an interior edge defining an aperture extending through said hose guide;

a sheet coupled to said hose guide, said sheet extending over said aperture;

a channel extending into said sheet, said channel being configured to receive a hose within said channel whereby said sheet is configured to scrape debris from the hose as the hose is moved through the hose guide;

a pair of feet, each of said feet being coupled to and extending from said frame wherein said feet support said frame in an upright position, each of said feet having a respective proximal end coupled to said frame and extending perpendicularly from a respective base of an associated one of a pair of lateral sides of said frame wherein said feet are configured for extending towards a reel mounted within a vehicle such that said frame is positionable between the reel and an opening into the vehicle, each of said feet having a hole extending therethrough wherein each of said feet is configured to be fastened into a fixed position in the vehicle; and said frame being pivotable relative to said feet wherein said frame is configured for being pivoted outwardly from the vehicle positioning said hose guide laterally spaced outside of the vehicle whereby debris contacting said sheet and said hose guide is urged to fall away from the hose outside of the vehicle.

10. A hose cleaning reel attachment assembly comprising:

a frame, said frame having a base bar, a pair of lateral sides, each of said lateral sides being coupled to and extending from a respective end of said base bar, said frame having a pair of top bars coupled to and extending between said lateral sides, said top bars being parallel and spaced to define a slot between said top bars, said slot being vertically aligned with said base bar;

a pivot arm having a first end and a second end, said second end being pivotally coupled to said frame, said second end of said pivot arm being coupled to a middle of said frame, a hose guide being coupled to said first end, said pivot arm extending through said slot;

said hose guide coupled to said frame such that said hose guide is movable between opposite ends of said frame, said hose guide having an interior edge defining an aperture extending through said hose guide, said hose guide having a pivot section pivotally coupled to a fixed section, said fixed section being fixedly coupled to said first end of said pivot arm, said pivot section being pivotable between an open position and a closed position, said pivot section and said fixed section overlapping in said closed position to define said interior edge and said aperture, said pivot section and said fixed section defining an opening into said aperture when in said open position wherein said pivot section is configured for being pivoted into said open position to permit insertion of a hose into said aperture;

a sheet coupled to said hose guide, said sheet extending over said aperture; and a channel extending into said sheet, said channel being configured to receive the hose within said channel whereby said sheet is configured to scrape debris from the hose as the hose is moved through the hose guide;

a handle coupled to and extending from said hose guide, said handle having a first section coupled to and extending from said fixed section of said hose guide, said handle having a second section coupled to and extending from said pivot section, said first section of said handle being aligned with said second section of said handle when said pivot section is in said closed position;

a pair of feet, each of said feet being coupled to and extending from said frame wherein said feet support said frame in an upright position, each of said feet having a respective proximal end coupled to said frame and extending perpendicularly from a respective base of an associated one of said lateral sides of said frame wherein said feet are configured for extending towards a reel mounted within a vehicle such that said frame is positionable between the reel and an opening into the vehicle, each of said feet having a hole extending therethrough wherein each of said feet is configured to be fastened into a fixed position in the vehicle; and said frame being pivotable relative to said feet wherein said frame is configured for being pivoted outwardly from the vehicle positioning said hose guide laterally spaced outside of the vehicle whereby debris contacting said sheet and said hose guide is urged to fall away from the hose outside of the vehicle; and a plurality of rollers, each of said rollers being coupled to said hose guide proximate to said aperture wherein each of said rollers is configured to facilitate passing the hose through said aperture, said plurality of rollers being arranged into a U shape extending around said aperture, an open end of said U shape being directed towards said pivot arm.

* * * * *